US005331730A

United States Patent [19]

Brinn, Jr.

[11] Patent Number: 5,331,730

[45] Date of Patent: Jul. 26, 1994

[54] METHOD OF MAKING A COIL MOLDED INTO A MAGNETIC STATOR

[75] Inventor: Benjamin F. Brinn, Jr., Williamsburg, Va.

[73] Assignee: Siemens Automotive L.P., Auburn Hills, Mich.

[21] Appl. No.: 939,802

[22] Filed: Sep. 3, 1992

[51] Int. Cl.[5] ..... H01F 41/10

[52] U.S. Cl. ..... 29/606; 264/272.19; 336/96

[58] Field of Search ..... 29/605, 602.1, 606; 264/272.19; 336/96

[56] References Cited

U.S. PATENT DOCUMENTS 3,045,290 7/1962 Anderson et al. ..... 264/272.19 X
3,240,848 3/1966 Burke et al. ..... 264/272.19 X
3,525,966 8/1970 Wierzbinski ..... 29/605 X
4,982,498 1/1991 Umezaki ..... 29/602.1
5,226,221 7/1993 Kilgore ..... 29/605

*Primary Examiner*—Carl E. Hall
*Attorney, Agent, or Firm*—George L. Boller; Russel C. Wells

[57] ABSTRACT

An unencapsulated bobbin-mounted coil is associated with a stator wherein the stator, in cooperation with other parts of a mold, define a mold cavity. Encapsulating material is injected through gates in one of the other mold parts into the defined mold cavity to encapsulate the coil and bobbin in their entirety, including attachments of the finish lead ends of the coil wire to bobbin-mounted electrical terminals that extend axially away from the bobbin and coil, except for distal end portions of the terminals. The process simultaneously joins the encapsulated coil and bobbin with the stator.

6 Claims, 3 Drawing Sheets

METHOD OF MAKING A COIL MOLDED INTO A MAGNETIC STATOR

FIELD OF THE INVENTION

This invention relates to solenoids and methods of making solenoids.

BACKGROUND AND SUMMARY OF THE INVENTION

From commonly assigned U.S. Pat. No. 5,065,128, it is known to injection-mold encapsulating material around an electromagnetic coil, thereby creating an encapsulated coil, and then to use the encapsulated coil in the solenoid of a solenoid-actuated valve, such as in U.S. Pat. Nos. 5,083,747 and 5,102,095, also commonly assigned.

From pending, commonly assigned U.S. Ser. No. 07/614,463, now U.S. Pat. No. 5,226,221, it is known to support an electromagnetic coil on a holder that contains electrical terminals to which terminations of the coil have been attached, to injection-mold encapsulating material around the coil and holder except for distal end portions of the electrical terminals, thereby creating an encapsulated coil, and then to use the encapsulated coil in a solenoid.

When an electromagnetic coil is used in a solenoid-actuated valve, it is typically associated with a stator. Often epoxy is employed to join the two together by adhesive bonding, a process that may be relatively costly, messy, and time-consuming, and occasionally ineffective in achieving a desired degree of bonding.

An encapsulated coil may be associated with a stator by inserting one into the other, in which case dimensional control of the encapsulation must be carefully practiced in order to assure that proper insertion will be attained.

The present invention relates to a new and improved means and method for associating an encapsulated electromagnetic coil with a stator. Briefly, and in a general way, the invention comprises disposing an unencapsulated bobbin-mounted coil in association with a stator wherein the stator, in cooperation with other parts of a mold, define a mold cavity, and then injecting encapsulating material through gates in one or more of such other mold parts into the mold cavity to simultaneously encapsulate the coil and bobbin in their entirety, including attachments of the finish lead ends of the coil wire to bobbin-mounted electrical terminals that extend axially away from the bobbin and coil, except for distal end portions of the terminals, and join the encapsulated coil and bobbin with the stator.

By uniting an unencapsulated bobbin-mounted coil and a stator together in this manner, it may be possible to attain improved flow of encapsulating material into the mold cavity and thicker encapsulation covering the coil in comparison to the prior method described above of first encapsulating the coil and thereafter inserting it into the stator.

The invention possesses additional features that are beneficial to the overall fabrication process. They relate to separating the assembly from the mold after the encapsulating step and to the fabrication of the bobbin. Further features, advantages, and benefits of the invention will be seen in the ensuing description and claims which should be considered in conjunction with accompanying drawings. These drawings illustrate a presently preferred embodiment of the invention according to the best mode contemplated at this time for carrying out the invention.

DESCRIPTION OF THE PREFERRED EMBODIMENT

Figure 1:
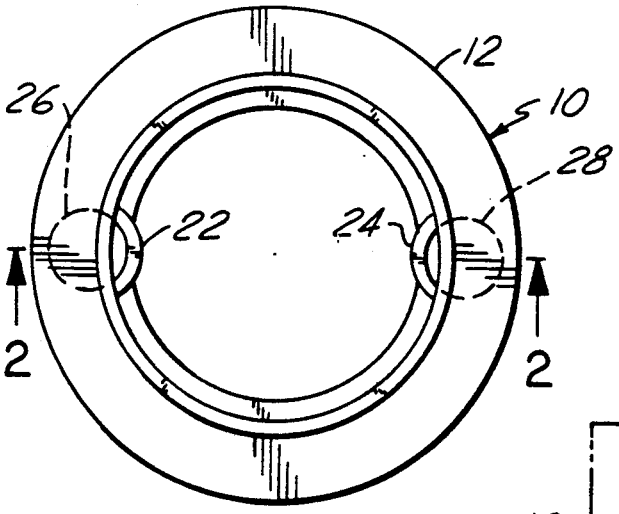
FIG. 1 is a top plan view of the bobbin and electrical terminals.
Figure 2:
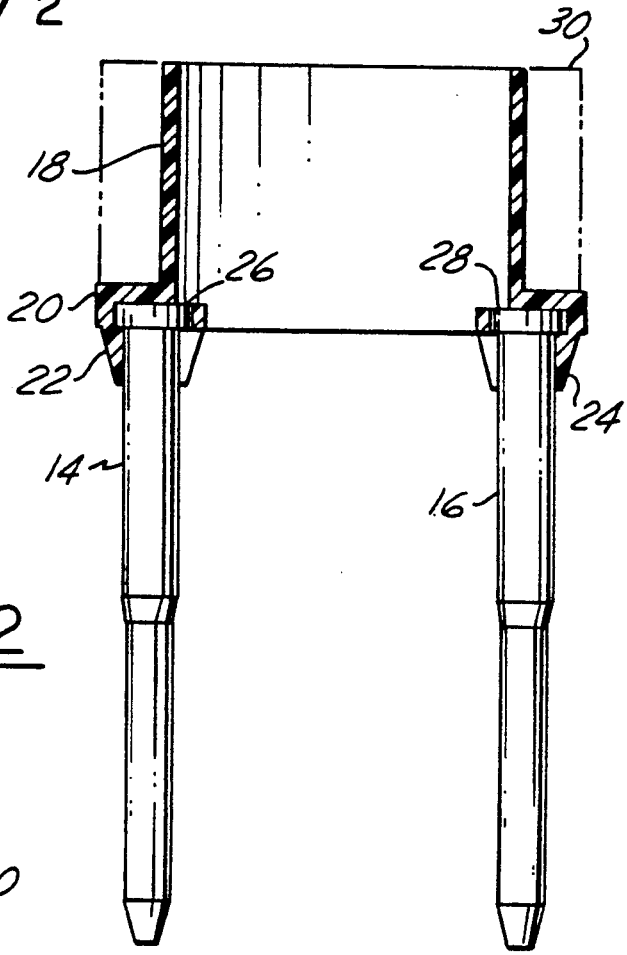
FIG. 2 is a diametrical cross section in the direction of arrows 2—2 in FIG. 1.
Figure 3:
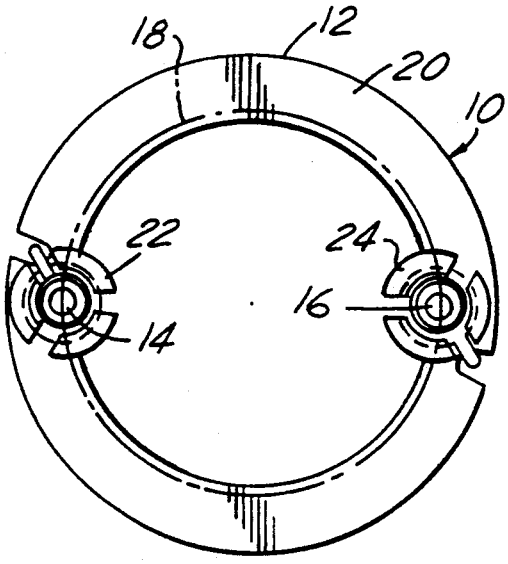
FIG. 3 is a bottom plan view of the bobbin and electrical terminals.

FIGS. 1–3 show a bobbin-terminal sub-assembly 10 consisting of a non-metallic bobbin 12 and two electrical terminals 14, 16. Bobbin 12 comprises a circular cylindrical sidewall 18 having a circular annular ledge, or flange, 20 extending circumferentially around the outside of its lower end. Diametrically opposite each other, and extending downwardly from on the lower face of ledge 20, are two terminal-engaging sockets 22, 24 respectively. Terminals 14, 16 have proximal end portions, including respective circular heads 26, 28, that are engaged respectively by sockets 22, 24 to secure the terminals in assembly with bobbin 12. An electromagnetic coil 30 (depicted in phantom in FIG. 1) is disposed on bobbin 12, upright on the upper face of ledge 20.

Bobbin-terminal sub-assembly 10 is advantageously fabricated by molding bobbin 12 directly onto terminals 14, 16 when the bobbin is fabricated. This imparts rigidity and strength that are beneficial for the subsequent encapsulation step that will be described in more detail later on.

Figure 4:
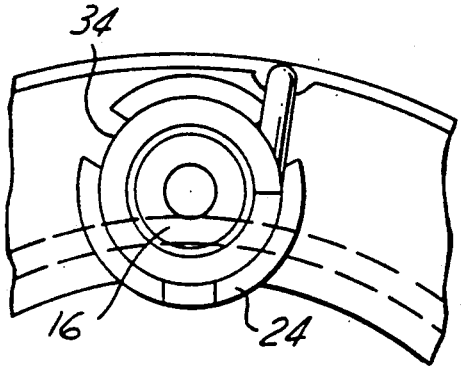
FIG. 4 is a fragmentary enlarged view of a portion of FIG. 3 showing detail of attaching an end of the coil wire to one of the electrical terminals.
Figure 5:
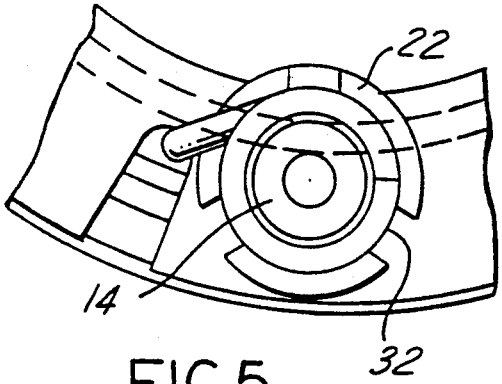
FIG. 5 is a fragmentary enlarged view of another portion of FIG. 3 showing detail of attaching another end of the coil wire to the other of the electrical terminals.

Coil 30 is a length of insulated wire that is wound around sidewall 18. Its opposite ends form start and finish leads that are brought over and around the edge of ledge 20, through respective slots in the edge of the ledge, and wrapped around the respective terminals 14, 16 at locations 32, 34 just below sockets 22, 24 to establish electrical continuity that places coil 30 across the terminals, as shown in enlarged detail in FIGS. 4 and 5.

Figure 6:
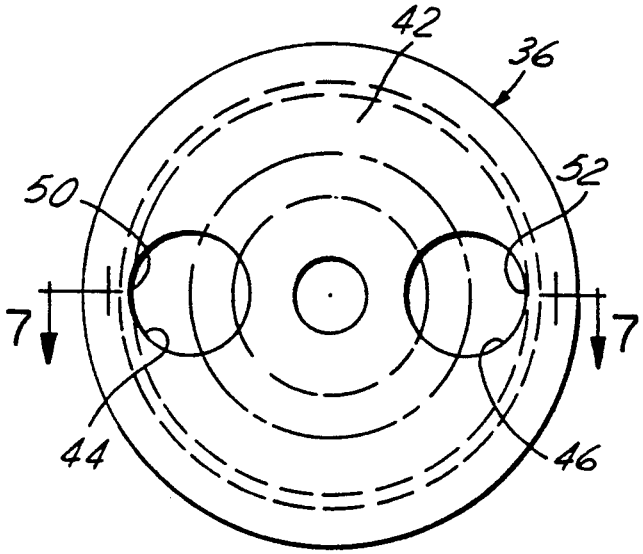
FIG. 6 is a bottom plan view of the stator by itself.
Figure 7:
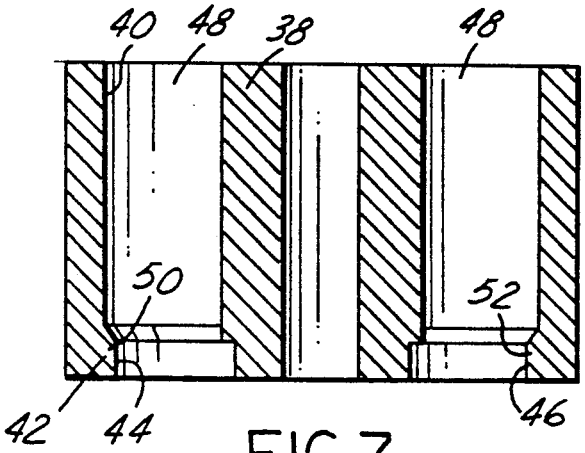
FIG. 7 is a diametrical cross section in the direction of arrows 7—7 in FIG. 6.

FIGS. 6 and 7 show detail of a stator 36 with which the bobbin-terminal-coil sub-assembly is to be associated in accordance with principles of the invention. Stator 36 comprises concentric inner and outer tubes 38, 40 that are joined at one end by a transverse circular end wall 42. Diametrically opposite each other in a radially intermediate zone of end wall 42 are two circular through-holes 44, 46 which are open to a circular annular cylindrical space 48 that radially separates tubes 38, 40. In general, through-holes 44, 46 are slightly radially inwardly offset relative to space 48. Immediately proximate the inner ends of through-holes 44, 46, the I.D. of outer tube 40 is counter-bored so that the intersection of each through-hole 44, 46 with space 48 creates small lips 50, 52.

Figure 8:
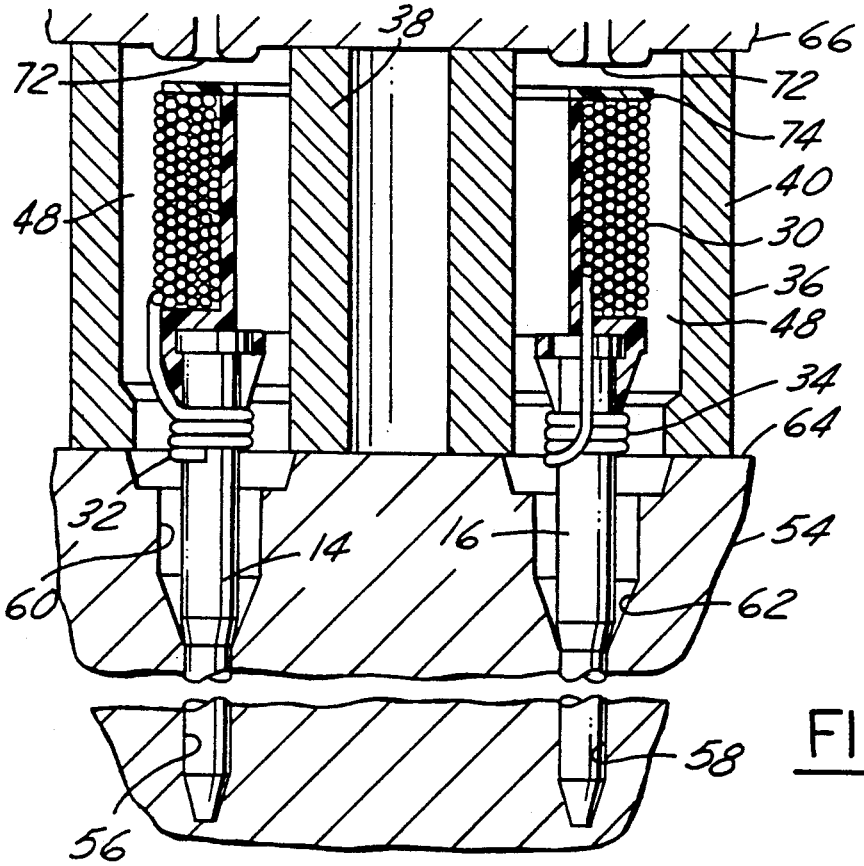
FIG. 8 is a diametrical cross section of the bobbin-mounted coil associated with the stator prior to the encapsulating step.

The process of associating the bobbin-terminal-coil sub-assembly with stator 36 comprises disposing the two in the manner portrayed by FIG. 8. The bobbin-terminal-coil sub-assembly is supported uprightly on a lower mold part 54. The distal ends of terminals 14, 16 are inserted into respective cavity holes 56, 58 in mold part 54. Each hole 56, 58 comprises a stepped counterbore 60, 62 extending to a flat upper surface 64 of mold part 54 from the lowermost portion of each hole that closely receives the distalmost end portion of each terminal. The lower end face of stator 36 is placed flat against mold part surface 64. Suitable indexing means (not shown) is provided to assure that stator 36 is properly indexed relative to the bobbin-terminal-coil sub-assembly.

Next an upper mold part 66 is disposed to engage flat regions of its lower end face 68 with the flat and co-planar upper ends of stator tubes 38, 40. Where upper mold part 66 overlies space 48, its lower face 68 contains a circular annular downwardly projecting ridge 70. At one or more locations around ridge 70 are one or more gates 72 via which encapsulating material is introduced to encapsulate the bobbin-mounted coil. The unoccupied portions of space 48 and counterbores 60, 62 thus form a mold cavity that is co-operatively defined by the two mold parts 54, 66, and stator 36 itself as a third mold part.

Figure 9:
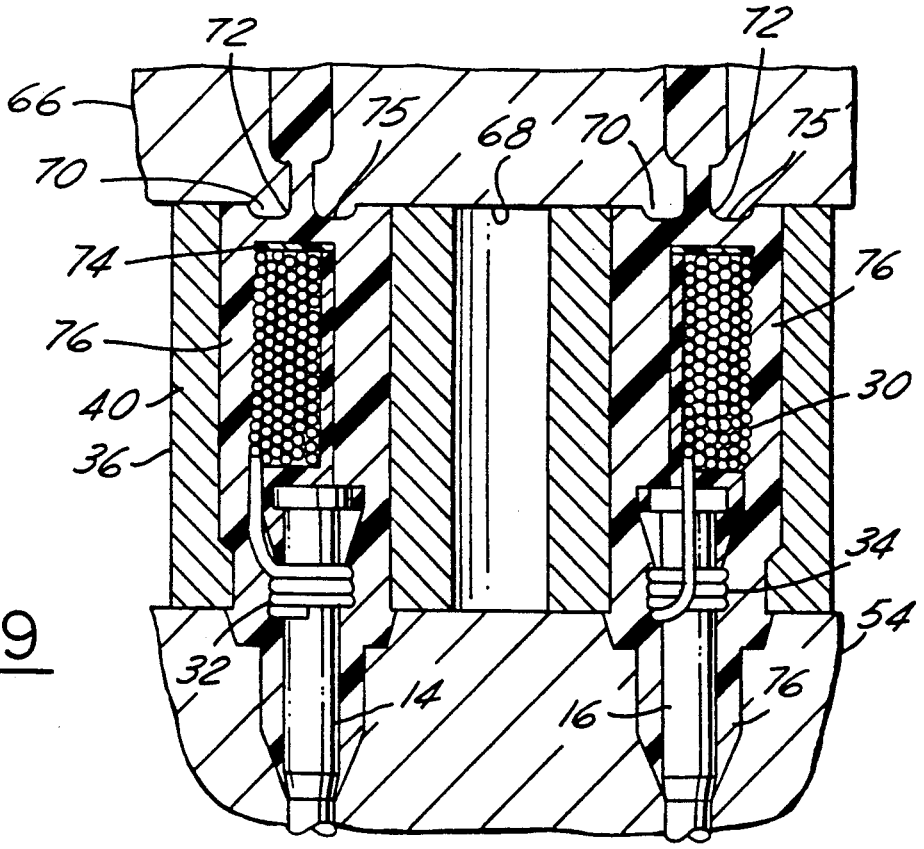
FIG. 9 is a diametrical cross section of the bobbin-mounted coil associated with the stator subsequent to the encapsulating step.

The encapsulating step is conducted by injecting encapsulating material into this mold cavity via gate(s) 72. Since this is typically done under pressure, the strength and rigidity that have been imparted to the mounting of terminals 14, 16 on bobbin 12 will serve to adequately support the sub-assembly within the mold cavity during the pressure of encapsulant injection. It is desirable to place an annular film tape 74 over the upper end of the coil as shown in FIGS. 8 and 9 since the upper end of the bobbin, unlike the lower end, is flangeless. (Such a one-flanged bobbin can be fabricated with less complicated tooling than a two-flanged one.) The purpose of using tape 74 is to prevent significant intrusion of encapsulating material into the coil winding that might result in shorted turns. The "nail-head" shape of terminals 14, 16, in addition to providing terminal-bobbin rigidity, tends to resist intrusion of encapsulating material between turns of the coil at the points of attachment of the terminals to the bobbin.

FIG. 9 shows the condition at the completion of the injection of encapsulating material into the described mold cavity. The encapsulating material is allowed to solidify into encapsulant 76 before the two mold parts 54, 66 are separated from stator 36. By providing ridge 70 and gate(s) 72 as shown and described, a depression 75 is created in that end of encapsulant 76 so that when the upper mold part 66 is separated from stator 36, any sprue on the end of encapsulant 76 will not protrude beyond the upper ends of inner and outer stator tubes 38, 40.

The finished solenoid coil assembly has encapsulant 76 seamlessly sealing the coil and bobbin and securely uniting the bobbin-terminal-coil sub-assembly with the stator by bonding due to the nature of the encapsulant material. The encapsulant also axially interlocks on lips 50, 52 to provide an interference-type of axial interlocking with the stator. The encapsulant fully covers the points of attachment of the coil's finish lead ends to terminals 14, 16, but leaves the distalmost end portions of the terminals uncovered so that they can be connected with an electrical connector (not shown) when the assembly is used.

One contemplated use of the solenoid coil assembly is in a solenoid-actuated valve, such as a fuel injector. The solenoid may be exposed to hydraulic pressure and fluid (fuel) itself, and the superior encapsulation of the coil and uniting of parts that are attained with the present invention can be significant contributors to a commercially acceptable product.

While a presently preferred embodiment of the invention has been illustrated and described, it should be appreciated that principles are applicable to other embodiments.

What is claimed is:

1. A method of making a solenoid coil assembly comprising a bobbin, a pair of electrical terminals having proximal end portions mounted on said bobbin and distal end portions providing for connection with a separable electrical connector, a length of wire disposed as a solenoid coil on said bobbin and having opposite ends attached with said electrical terminals to electrically place the coil across said terminals, a stator comprising an inner tube disposed on the interior of said bobbin and an outer tube disposed on the exterior of said bobbin, and an encapsulant encapsulating the entirety of said coil and bobbin, including the mounting of said terminals' proximal end portions on said bobbin and the attachment of said wire with said terminals, and joining with said stator so that said bobbin, coil, terminals, and stator form a unitary solenoid coil assembly, said method comprising fabricating said bobbin and terminals as a sub-assembly, placing said sub-assembly and said stator in a mold that has first and second mold parts that coact respectively with respective axial ends of both said inner and outer tubes of said stator to define a mold cavity such that said terminals project axially from one end thereof, and then injecting encapsulating material into said mold cavity to fabricate said encapsulant and thereby create the unitary solenoid coil assembly.

2. A method as set forth in claim 1 in which one of said inner and outer tubes of said stator comprises a circumferentially extending lip, and the step of injecting encapsulating material into said mold cavity includes injecting encapsulating material around said lip such that in the finished unitary solenoid coil assembly said encapsulant axially interlocks with said lip.

3. A method as set forth in claim 1 in which the step of injecting encapsulating material into said mold cavity includes molding encapsulating material around intermediate portions of said terminals that are immediately distal to the attachment of said wire with said terminals but short of said distal end portions, said intermediate end portions extending axially beyond said inner and outer tubes.

4. A method of making a solenoid coil assembly comprising a bobbin, a pair of electrical terminals having proximal end portions mounted on said bobbin and distal end portions providing for connection with a separable electrical connector, a length of wire disposed as a solenoid coil on said bobbin and having opposite ends attached with said electrical terminals to electrically place the coil across said terminals, a stator comprising an inner tube disposed on the interior of said bobbin and an outer tube disposed on the exterior of said bobbin, and an encapsulant encapsulating the entirety of said coil and bobbin, including the mounting of said terminals' proximal end portions on said bobbin and the attachment of said wire with said terminals, and joining with said stator so that said bobbin, coil, terminals, and stator form a unitary solenoid coil assembly, said method comprising fabricating said bobbin and terminals as a sub-assembly, placing said sub-assembly and said stator in a mold that has first and second mold parts that coact with said stator, as a third mold part, to define a mold cavity such that said terminals project axially from one end, and then injecting encapsulating material into said mold cavity to fabricate said encapsulant and thereby create the unitary solenoid coil assembly, in which the step of injecting encapsulating material into said mold cavity comprises injecting the encapsulating material into an axial end of the cavity opposite the one end from which the terminals project and creating a depression therein that is depressed relative to immediately proximate axial ends of said inner and outer tubes.

5. A method as set forth in claim 4 in which an axial end of said bobbin that is proximate said depression is flangeless and the proximate axial end of said coil is covered by an annular layer of material.

6. A method of making a solenoid coil assembly comprising a bobbin, a pair of electrical terminals having proximal end portions mounted on said bobbin and distal end portions providing for connection with a separable electrical connector, a length of wire disposed as a solenoid coil on said bobbin and having opposite ends attached with said electrical terminals to electrically place the coil across said terminals, a stator comprising an inner tube disposed on the interior of said bobbin and an outer tube disposed on the exterior of said bobbin, and an encapsulant encapsulating the entirety of said coil and bobbin, including the mounting of said terminals' proximal end portions on said bobbin and the attachment of said wire with said terminals, and joining with said stator so that said bobbin, coil, terminals, and stator form a unitary solenoid coil assembly, said method comprising fabricating said bobbin and terminals as a sub-assembly, placing said sub-assembly and said stator in a mold that has first and second mold parts that coact with said stator, as a third mold part, to define a mold cavity such that said terminals project axially from one end, and then injecting encapsulating material into said mold cavity to fabricate said encapsulant and thereby create the unitary solenoid coil assembly, and in which the step of injecting encapsulating material into said mold cavity comprises injecting the encapsulating material into an axial end of the cavity opposite the one end from which the terminals project.

* * * * *